United States Patent [19]

Fritzvold et al.

[11] 4,450,044

[45] May 22, 1984

[54] METHOD FOR BLEACHING OXYGEN DELIGNIFIED CELLULOSE-CONTAINING PULP WITH OZONE AND PEROXIDE

[75] Inventors: Bjørn H. Fritzvold, Hosle; Nicolai Soteland, Oslo, both of Norway

[73] Assignee: Myrens Verksted A/S, Oslo, Norway

[21] Appl. No.: 400,115

[22] Filed: Jul. 19, 1982

Related U.S. Application Data

[63] Continuation of Ser. No. 161,871, Jun. 23, 1980, abandoned, which is a continuation of Ser. No. 26,644, Apr. 3, 1979, abandoned.

[30] Foreign Application Priority Data

Apr. 4, 1978 [NO] Norway ..... 781190

[51] Int. Cl.[3] ..... D21C 9/16

[52] U.S. Cl. ..... 162/65; 162/78

[58] Field of Search ..... 162/78, 65, 90, 24, 162/76, 19; 8/156, 111

[56] References Cited

U.S. PATENT DOCUMENTS

| | | | |
|---|---|---|---|
| 3,944,463 | 3/1976 | Samuelson et al. | 162/78 |
| 3,966,542 | 6/1976 | Oldshue | 162/57 |
| 4,123,317 | 10/1978 | Fritzvold et al. | 162/65 |

OTHER PUBLICATIONS

Rothenberg, "Bleaching of Oxygen Pulps with Ozone", *Tappi*, vol. 58, No. 8, pp. 182–185, Aug. 1975.

Soteland, "Bleaching of Chemical Pulps with Oxygen and Ozone", Pulp & Paper Mag. of Canada, vol. 75, No. 4, p. 1153, (4–1974).

Hosukawa, "The Brightness and Stability of Ozone Bleached Kraft Pulp Treated with Hydrogen Peroxide", Govt. Ind. Research, Feb. 1976.

*Primary Examiner*—Steve Alvo

*Attorney, Agent, or Firm*—Holman & Stern

[57] ABSTRACT

In a method for bleaching oxygen delignified cellulose-containing pulp such as sulphate, sodium and sulphite pulps with ozone and peroxide, the ozone treatment takes place at two stages, the alkaline solution which is added subsequent to the ozone treatment includes peroxide and complex formers, and 55 to 85% of the total amount of chemicals is added at the first stage.

13 Claims, 1 Drawing Figure

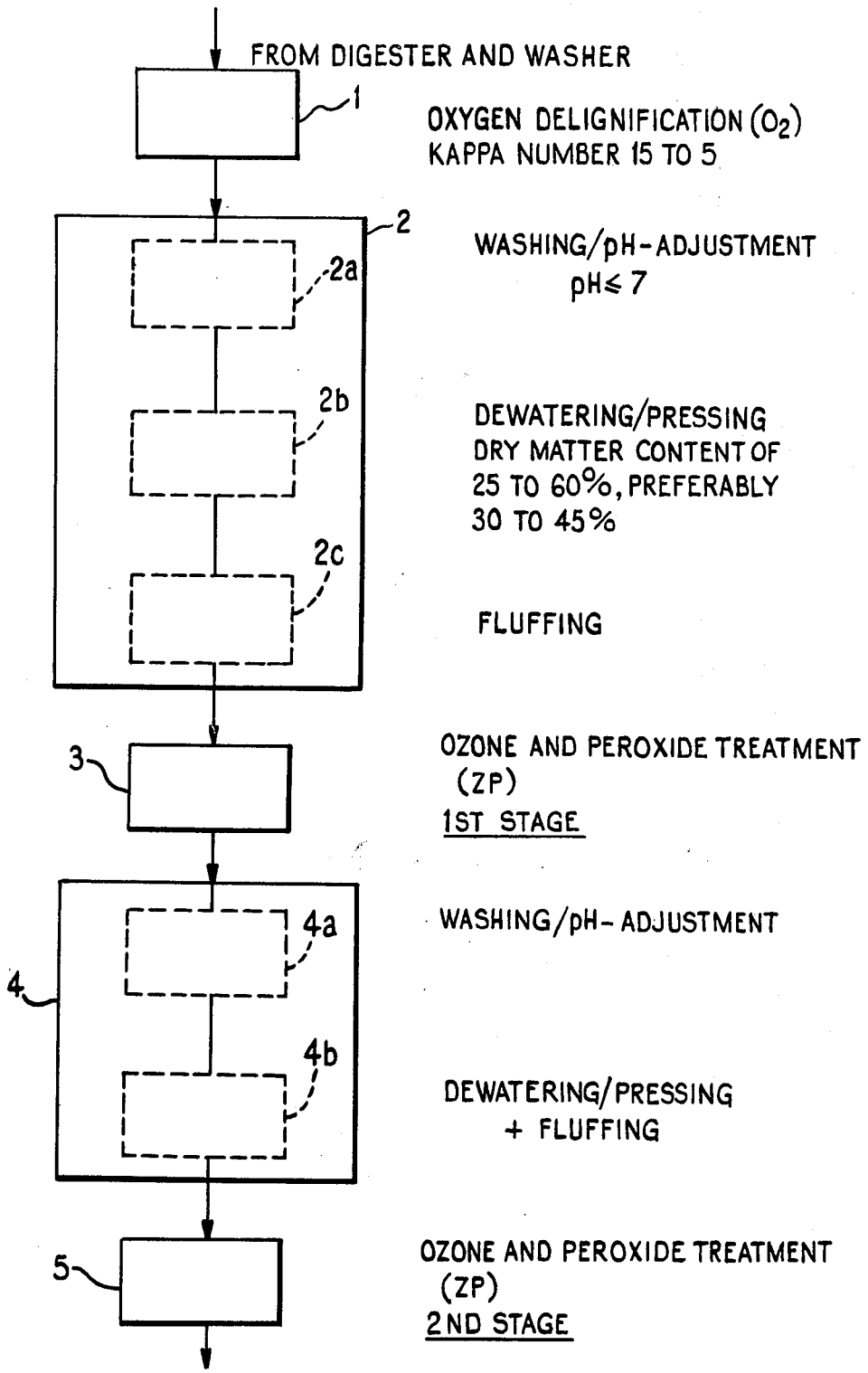
FROM DIGESTER AND WASHER
1
OXYGEN DELIGNIFICATION ($O_2$)
KAPPA NUMBER 15 TO 5
2
2a
WASHING/pH-ADJUSTMENT
pH≤7
2b
DEWATERING/PRESSING
DRY MATTER CONTENT OF
25 TO 60%, PREFERABLY
30 TO 45%
2c
FLUFFING
3
OZONE AND PEROXIDE TREATMENT
(ZP)
1ST STAGE
4
4a
WASHING/pH-ADJUSTMENT
4b
DEWATERING/PRESSING
+ FLUFFING
5
OZONE AND PEROXIDE TREATMENT
(ZP)
2ND STAGE

METHOD FOR BLEACHING OXYGEN DELIGNIFIED CELLULOSE-CONTAINING PULP WITH OZONE AND PEROXIDE

This is a continuation of application Ser. No. 161,871, filed June 23, 1980, now abandoned which in turn is a continuation of Ser. No. 026,644, filed on Apr. 3, 1979, now abandoned.

BACKGROUND OF THE INVENTION

1. Field of the Art

The present invention relates to a method for bleaching oxygen delignified cellulose-containing pulp such as sulphate, sodium and sulphite pulps with ozone and peroxide.

2. Statement of Prior Art

Usual bleaching processes for producing completely bleached pulps (degree of whiteness=88% MGO) comprises one or two chlorinating stages in which elementary chlorine is used and in most cases one or two additional hypochlorite stages and one or two chlorine dioxide stages. In the chlorinating stage in which generally 4–8% $Cl_2$ calculated of the quantity of the pulp, is used, large quantities of hydrochloric acid are formed, which entails that the backwater contains large quantities of this acid or sodium chloride if the acid is neutralized. Besides, the backwater will contain organic chlorine compounds. To a lesser degree this is also the case in the hypochlorite bleaching and the chlorine dioxide bleaching.

These organic substances and above all the organic substances which are dissolved during the bleaching of the pulp, mean a heavy charge on the water courses and the lakes into which the backwater is discharged. Besides, the chlorine containing liquids are strongly corrosive and will create large difficulties in a recovery system.

In this connection large efforts have been made to arrive at a bleaching process in which the stage of chlorine bleaching may be replaced by a stage of oxygen bleaching.

However, up till now no method is known in which, through the application of oxygen, the use of chlorine containing bleaching agents (chlorine dioxide) may be avoided for achieving completely bleached qualities.

As examples of conventional bleaching sequences the following stages of treatment may be referred to: C/E/H, C/E/H/E/H, C/E/H/H, C/E/H/D, C/E/D-/E/D, C/E/H/D/P, C/E/H/D/E/D, C/E/H/E/D and C/E/H/D/E/H.

Recently one has tried to reduce the quantity of chlorine containing bleaching agent by replacing chlorine (C) with oxygen ($O_2$), but chlorine dioxide must still be used to achieve completely bleached qualities. Examples of such sequences of treatment are as follows: A/$O_2$/D/E/D, $O_2$/D/E/D, $O_2$/D/E/D, A/$O_2$/D/P/D.

In the above-mentioned sequences the designations mean: C: chlorine, E: alkali, H: hypochlorite, D: chlorine dioxide, P: peroxide, $O_2$: oxygen, A: acid wash, Z: ozone.

From Swedish Patent Specification No. 7305671-5 there is known a 4 to 5-stage chlorine-free bleaching process with alternating use of peroxide and peracid. However, such a process is very costly with today's prices of the chemicals included in the process and will hardly find practical application.

SUMMARY OF THE INVENTION

The main object of the present invention is to give instructions for a method for bleaching cellulose-containing pulps without the use of chlorine-containing bleaching agents for thereby avoiding the corrosion problems and the charges on the environment involved in such bleaching processes.

Thus, the method according to the present invention relates to a method for bleaching oxygen delignified cellulose-containing pulps with ozone and peroxide, which aside from being free of the above-mentioned disadvantages, also may be directly included in an existing recovery system.

The method according to the invention is characterized in that the ozone treatment takes place at two stages, that the alkaline solution which is added subsequent to the ozone treatment, includes peroxide and complex formers, and that 55 to 85% of the total quantity of chemicals is added at the first stage.

In the magazine Pulp and Paper Mag. Can. Vol. 75 No. 4. T153 (1974) there is in an article by N. Soteland described a method for ozone and peroxide bleaching which may be regarded as a forerunner of the present invention. However, in several types of pulps the known method does not yield a satisfactory result as regards quality. This is due to the large quantities of chemicals (ozone) which had to be used for obtaining satisfactory brightness, i.e. completely bleached qualities, and these large quantities of chemicals resulted in an unwanted large reduction of strength in the cellulose pulp.

However, by the method of the present invention completely bleached pulp qualities having satisfactory strength properties are achieved.

A further particular feature of the method according to the invention is to the effect that the pulp is oxygen delignified to a kappa number of 15 to 5 prior to bleaching with ozone and perioxide.

BRIEF DESCRIPTION OF THE DRAWING

The invention will in the following be further described, references being had to the drawing, which is a general flow chart of the method according to the invention.

DESCRIPTION OF AN EMBODIMENT

As illustrated in the drawing digested and washed cellulose-containing pulp is supplied to an oxygen delignifying stage 1 in which the pulp in a known manner is oxygen delignified to a kappa number in the range of 15 to 5.

From the $O_2$-stage the now alkaline pulp is passed to a stage 2, in which the pulp is washed, dewatered and fluffed. The combined washing and pH-adjustment of the pulp is symbolized by the lesser block 2*a*, the pulp herein having its pH-value adjusted to less than or equal to 7. For sulphate pulps this may preferably be carried out by sulphuric acid. For sulphite pulps the acid condensates from the sulphite digestion itself are used. The pulp is subjected to washing for removing the oxygen treated lignin compounds from the $O_2$-stage.

The block designated 2*b* symbolizes dewatering of the pulp to a dry matter content of 25 to 60%, preferably between 30 and 45%.

The block 2*c* illustrates the fluffing stage, the pulp here being given a finely divided and fluffy form for thereto thereby achieve the largest possible specific surface for the gas reaction.

The fluffed pulp is subsequently treated with ozone in an ozone reactor 3, preferably of the type disclosed in U.S. Pat. No. 4,123,317, whereafter the ozone-treated pulp is treated with alkaline bleaching liquid (NaOH, $H_2O_2$, DTPA) in an underlying high consistency maturation reactor, preferably of the type disclosed in a pending U.S. patent application Ser. No. 900,098.

The ozone and peroxide treated pulp is thereafter passed to a washing and dewatering stage 4, in which the block 4a indicates washing and pH-adjustment. The pH-adjustment may be carried out by adding sulphuric acid ($H_2SO_4$) in the washing water, as this entails a gain of 2 to 3 units of brightness.

The block 4b of the stage 4 indicates dewatering/-pressing preferably to a dry matter content of 30 to 45% of the washed and pH-adjusted pulp, which subsequent to the dewatering is fluffed to a light and airy consistency.

In the drawing, 5 indicates ozone and peroxide treatment stage No. 2, which is of the same type as that described above in connection with stage 3.

55 to 85% of the total quantity of chemicals is added to stage 3, whereas the rest of the chemicals, i.e. 45 to 15% is added in the ozone and peroxide treatment stage 5.

EXAMPLES

EXAMPLE 1

An oxygen delignified sulphate pulp from eucalyptus having a kappa number of 7 and viscosity of 850 $dm^3/kg$ is pressed to a dry matter content of 40%, is fluffed and ozone treated with 0.4% $O_3$. Immediately after the ozonization the pulp is mixed with a liquid consisting of water+NaOH+$H_2O_2$+DTPA (diethylenetriamine-pentaacetate) such that the dry matter content reaches 25%, and such that the quantity of chemicals relative to the pulp quantity becomes 0.6%, 0.2% and 0.2%, respectively.

With this mixture the pulp is treated for an hour at 90° C. Thereafter, the pulp is pressed, the pH-value is adjusted to 2 with sulphuric acid and the pulp is ozone treated once more with 0.2% $O_3$.

After the ozonization the pulp is mixed with a liquid consisting of bleaching liquid which is depressed from the first peroxide bleaching stage+NaOH+$H_2O_2$+D-TPA, such that the quantities of chemicals relative to the pulp quantity becomes 0.4%, 0.1% and 0.1%, respectively.

After a treatment period of 1 hour at 90° C. the pulp is washed and the pH-value is adjusted with $SO_2$-water. The result is indicated in Table I.

EXAMPLE 2

An oxygen delignified sulphate pulp from coniferous wood having a kappa number of 10 and viscosity of 800 $dm^3/kg$ is treated as in Example 1 under the application of 0.4% $O_3$ in the first ozonization stage and with respectively 1.4% NaOH, 0.8% $H_2O_2$ and 0.2% DTPA in the subsequent alkaline peroxide treatment.

Second stage treatment includes 0.2% $O_3$, 0.6% NaOH, 0.2% $H_2O_2$ and 0.1% DTPA.

The result can be seen in Table I.

EXAMPLE 3

A sulphite pulp of pine oxygen delignified with $Mg(OH)_2$ as a base in the oxygen stage and having a kappa number of 5 and viscosity of a 780 $dm^3/kg$, is treated as in Example 1. In the first stage 0.3% $O_3$, 8.5% NaOH, 0.2% $H_2O_2$ and 0.2% DTPA are used.

In the second stage 0.2% $O_3$, 0.3% NaOH, 0.1% $H_2O_2$ and 0.1% DTPA are used.

The result can be seen in Table I.

TABLE I

| Example No. | Type of oxygen delignified pulp | Total % ozone used | Total % peroxide used | ISO-brightness % | Viscosity $dm^3/kg$ |
|---|---|---|---|---|---|
| 1 | Eucalyptus sulphate | 0.6 | 0.3 | 90.5 | 590 |
| 2 | Coniferous wood sulphate | 0.6 | 1.0 | 89 | 610 |
| 3 | Pine sulphite | 0.5 | 0.3 | 91 | 650 |

What we claim is:

1. In a method of bleaching coniferous wood pulp wherein said pulp is first oxygen delignified to a kappa number of 5 to 15 and then bleached by treatment with ozone and peroxide, the improvement consisting essentially of the sequential steps of:

(A) a first stage having (1) an ozone treatment comprising the sequential steps of washing and pH adjustment with an acid to a pH≦7, dewatering to 25–60% dry matter, fluffing, and treatment with ozone, and immediately following the ozone treatment (2) an alkaline peroxide treatment comprising treatment with a composition consisting essentially of water, an alkaline, a complex former, and a peroxide; and (B) a second stage having (1) an ozone treatment comprising the sequential steps of washing and pH adjustment with an acid to a pH≦7, dewatering to 25–60% dry matter, fluffing, and treatment with ozone, and immediately following the ozone treatment (2) an alkaline peroxide treatment comprising treatment with a composition consisting essentially of water, an alkaline, a complex former, and a peroxide;

with the proviso that 55–85% of the total quantity of chemicals are used in the first stage.

2. The method of claim 1 wherein the pH adjustment with an acid is by the addition of sulfuric acid or acid condensates from a sulphite digestion process.

3. The method of claim 2 wherein the pulp being bleached is a sulphate pulp and the acid is sulfuric acid.

4. The method of claim 3 wherein the alkaline is NaOH, the peroxide is hydrogen peroxide, the complex former is diethylene triamine pentaacetate, the dewatering is to 30–45% dry matter, the amount of ozone employed is about 0.6% or less and the amount of peroxie employed is about 0.3% to 1% , both by weight based on the dry weight of the pulp.

5. The method of claim 2 wherein the pulp being bleached is a sulphite pulp and the acid is acid condensates from a sulphite digestion process.

6. The method of claim 5 wherein the alkaline is NaOH, the peroxide is hydrogen peroxide, the complex former is diethylene triamine pentaacetate, the dewatering is to 30–45% dry matter, the amount of ozone employed is about 0.6% or less and the amount of peroxide employed is about 0.3% to 1%, both by weight based on the dry weight of the pulp.

7. The method of claim 1 wherein the alkaline is NaOH.

8. The method of claim 1 wherein the peroxide is hydrogen peroxide.

9. The method of claim 8 wherein the total amount of peroxide employed is about 0.3% to 1%, by weight based on the dry weight of the pulp.

10. The method of claim 1 wherein the complex former is diethylene triamine pentaacetate.

11. The method of claim 1 wherein the dewatering is to 30–45% dry matter.

12. The method of claim 1 wherein the total amount of ozone employed is about 0.6% or less, by weight based on the dry weight of the pulp.

13. The method of claim 1 wherein the total amount of ozone employed is about 0.5% to 0.6%, by weight based on the dry weight of the pulp.

* * * * *